United States Patent [19]

Frassanito

[11] 4,394,938

[45] Jul. 26, 1983

[54] DISPENSER AND PACKAGE FOR LIQUID OR GRANULAR MATERIALS

[75] Inventor: John R. Frassanito, San Antonio, Tex.

[73] Assignee: Sani-Fresh International, Inc., San Antonio, Tex.

[21] Appl. No.: 176,909

[22] Filed: Aug. 11, 1980

[51] Int. Cl.[3] ..... G01F 11/02

[52] U.S. Cl. ..... 222/207; 222/214; 222/325

[58] Field of Search ..... 222/207, 209, 212, 213, 222/214, 325, 528, 529, 185

[56] References Cited

U.S. PATENT DOCUMENTS

| | | | |
|---|---|---|---|
| 1,770,630 | 7/1930 | Smith . | |
| 2,113,022 | 4/1938 | Hefti . | |
| 2,316,516 | 4/1943 | Hammerstein . | |
| 2,393,838 | 1/1946 | Tarbox | 222/209 |
| 2,456,504 | 12/1948 | Hammerstein . | |
| 2,473,707 | 6/1949 | Hammerstein . | |
| 2,488,854 | 11/1949 | Crane . | |
| 2,565,917 | 8/1951 | Hammerstein . | |
| 2,605,021 | 7/1952 | Churchill et al. . | |
| 2,758,755 | 8/1956 | Schafler . | |
| 2,772,817 | 12/1956 | Jauch . | |
| 2,939,615 | 6/1960 | Lerner . | |
| 3,066,832 | 12/1962 | Rossetti . | |
| 3,220,611 | 11/1965 | Zander . | |
| 3,224,650 | 12/1965 | Willits . | |
| 3,741,439 | 6/1973 | Vehrs | 222/103 |
| 3,768,704 | 10/1973 | Beguin | 222/207 |
| 3,870,201 | 3/1975 | Asplund | 222/207 |
| 4,042,153 | 8/1977 | Callahan et al. | 222/207 |
| 4,130,224 | 12/1978 | Norman et al. | 222/185 |
| 4,264,020 | 4/1981 | Loiseau | 222/214 |

FOREIGN PATENT DOCUMENTS

| | | | |
|---|---|---|---|
| 2812144 | 11/1978 | Fed. Rep. of Germany | 222/213 |

OTHER PUBLICATIONS

2 Sheets of drawings directed to a dispenser sold by applicant's assignee, which is one embodiment of the dispenser of U.S. Pat. No. 4,130,224.

*Primary Examiner*—H. Grant Skaggs
*Attorney, Agent, or Firm*—Ben D. Tobor

[57] ABSTRACT

An apparatus and package for liquid or granular materials includes two pivotally mounted dispensing blocks associated with a dispensing arm, whereby upon application of an actuating force to the dispensing arm, a resilient tube of the package is pinched shut by one dispensing block and the other dispensing block opens a slit diaphragm valve disposed within the resilient tube.

12 Claims, 9 Drawing Figures

DISPENSER AND PACKAGE FOR LIQUID OR GRANULAR MATERIALS

BACKGROUND OF THE INVENTION

1. Field of the Invention

The invention relates to a dispenser and package for liquid or granular materials, particularly for liquid or granular health and beauty care products.

2. Description of the Prior Art

Devices for the dispensing of a viscous liquid or granular material are known in the art. With respect to viscous liquid dispensers, these devices may, for example, use a roller moving over a resilient tube that is connected to a viscous liquid reservoir to expel viscous liquid from the tube. As the roller advances, the resilient tube is progressively compressed between the roller and a suitably disposed backup block. Examples of such prior devices are U.S. Pat. No. 2,113,002, issued to Hefti, and U.S. Pat. No. 3,006,832, issued to Rosetti.

Alternatively, other prior art dispensing devices for viscous liquids may utilize contact members which are first moved to constrict a portion of a resilient tube. Then, the contact member is forced into compressive contact with the resilient tube to cause viscous liquid to be expelled therefrom. Examples of the later type viscous liquid dispensers are U.S. Pat. No. 3,741,439 issued to Vehrs, and U.S. Pat. No. 3,870,201, issued to Asplund. It is usually a problem of prior art devices of any type to have an unsightly and unsanitary coagulated mass of viscous liquid remaining at the orifice of the resilient tube left from previous dispensing operations of viscous liquid from the dispenser. Furthermore, these liquid dispensers do not appear to be readily adapted to dispense granular materials.

Another prior art dispensing device which solved the problem of viscous liquid remaining at the orifice of the resilient tube is that shown in U.S. Pat. No. 4,130,224, to Norman and Frassanito. This dispenser utilized a yieldable dispensing lever arm to first constrict a portion of a resilient tube and included a spring bias, long throw, check valve disposed within the resilient tube for drawing liquid back into the resilient tube upon returning the dispensing arm to its original position. This device also included an arrangement for varying the amount of viscous liquid expelled in a given dispensing operation.

With respect to prior art devices for dispensing granular materials, many such devices utilize a flexible, slit diaphragm nozzle. The nozzle is opened upon application of a force to open the slit whereby the granular material is dispensed. Examples of such prior art devices are: U.S. Pat. No. 2,565,917, to Hammerstein; U.S. Pat. No. 2,473,707, to Hammerstein; and U.S. Pat. No. 3,224,650 to Willits. Such dispensers, while appearing to be capable of dispensing granular material, are not readily adapted to dispensing liquid materials.

Since many organizations may desire to have both liquid and granular materials, particular health and beauty care products such as soap, dispensed throughout their establishments, it would be desirable to install only one type of dispenser which could dispense either liquid or granular materials, depending upon what type of refill package is inserted in the dispenser. Therefore, a problem exists with prior art dispensers which are not capable of dispensing both liquid and granular materials. Furthermore, many of the prior art dispensers lack features which provide for adjusting the amount of material to be dispensed and preventing dripping from the dispenser when it is not in use.

Accordingly, prior to the development of the present invention, there has been no dispenser for use with both liquid and granular materials which is simple and economical to manufacture and operate, and can be loaded with a package containing either liquid or granular materials. Therefore, the art has sought a dispenser which: can be used with a package which contains either liquid or granular materials; is economical to manufacture; is easy to use; does not have an unsightly and unsanitary mass of liquid remaining at the nozzle of the dispenser; and can be adjusted to vary the amount of material being dispensed.

SUMMARY OF THE INVENTION

In accordance with the invention, the foregoing has been achieved through the present dispenser for use with a package which contains liquid or granular material that has a resilient tube associated with the package. The present invention includes: a housing including means for supporting a package containing liquid or granular material; a backup block having a compression surface thereon associated with the housing; a dispensing arm having a first end portion pivotably associated with the housing and having a second free end portion; a first dispensing block associated with the dispensing arm and being disposed adjacent the compression surface of the backup block; and a second dispensing block associated with the dispensing arm, which is disposed beneath, and spaced from the first dispensing block whereby, upon an actuating force being imposed upon the free end portion of the dispensing arm, the first dispensing block contacts the resilient tube of the package at a first predetermined impact point to compress the resilient tube against the compression surface of the backup block, and the second dispensing block contacts the resilient tube at a second predetermined impact point spaced from, and below, the first impact point, to apply a force to the resilient tube.

A feature of the present invention resides in the fact that the backup block is adjustably associated with the housing whereby, upon movement of the backup block, the amount of the compression surface adjacent the first dispensing block is varied. An additional feature is that the first dispensing block is pivotally connected to the dispensing arm. Another feature of the present invention is that the dispensing arm is yieldable with respect to the first dispensing block, and the dispensing arm includes a resilient spring disposed between the dispensing arm and the first dispensing block.

Another feature of the present invention is that the second dispensing block is pivotally connected to the dispensing arm and the dispensing arm is yieldable with respect to the second dispensing block, and includes a resilient spring disposed between the dispensing arm and the second dispensing block. The spring may be disposed at the pivotal connection between the dispensing arm and the second dispensing block.

The present invention also includes a package for use with a dispenser. The package of the present invention includes: a housing, having upper and lower ends, for containing the granular material; an opening formed in the lower end of the housing; a resilient tube, having upper and lower ends, extending downwardly from the lower end of the housing, the upper end of the tube being in communication with the opening to allow flow of the granular material from the interior of the housing into the tube; and a slit diaphragm valve disposed within the tube and disposed intermediate the upper and lower ends of the tube, and adapted to be opened and closed by the dispenser to allow egress of the granular material from the tube.

A further feature of the package of the present invention is that the package includes means for directing the granular material toward the opening in the housing, and may include at least one surface which is slanted with respect to the longitudinal axis of the housing.

A further feature of the package of the present invention is that the means for directing the granular material comprises four surfaces disposed within the lower end of the housing, which surfaces are slanted with respect to the longitudinal axis of the housing and are slanted downwardly toward the opening. A further feature of the present invention is that the lower end of the resilient tube includes means for positioning the lower end of the resilient tube within a dispenser, and the housing may include means for positioning the lower end of the housing within a dispenser.

The dispenser of the present invention, when compared with previously proposed prior art dispensers, has the advantages of ease of use, provides a positive seal to prevent leakage of the material from the dispenser, the amount of material being dispensed can be varied, and either liquid or granular materials can be dispensed.

While the invention will be described in connection with the preferred embodiment, it will be understood that it is not intended to limit the invention to that embodiment. On the contrary, it is intended to cover all alternatives, modifications, an equivalents as may be included within the spirit and scope of the invention as defined by the appended claims.

DETAILED DESCRIPTION OF THE INVENTION

Figure 1:
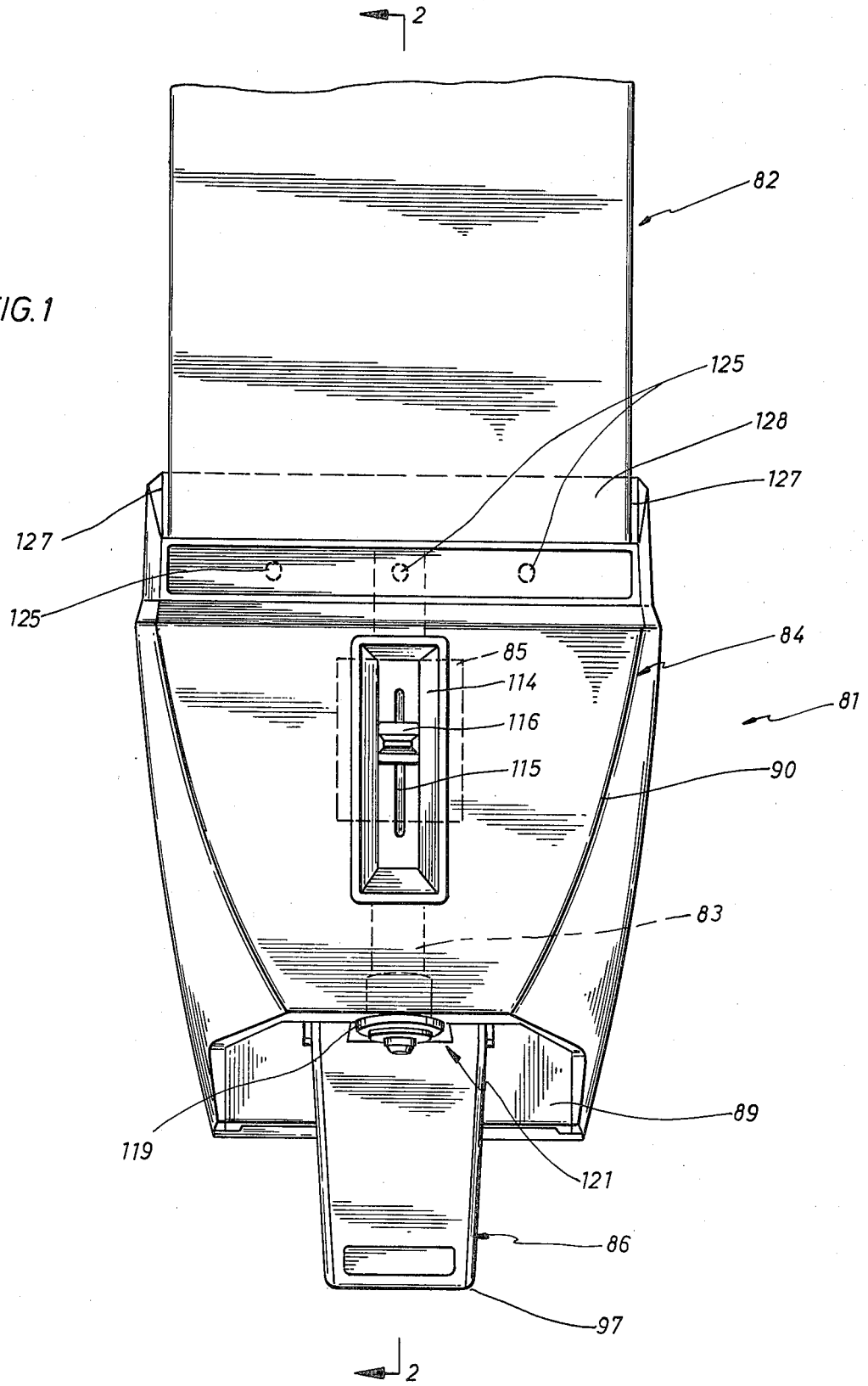
FIG. 1 is a front view of the dispenser for liquid or granular materials in accordance with the present invention.
Figure 2:
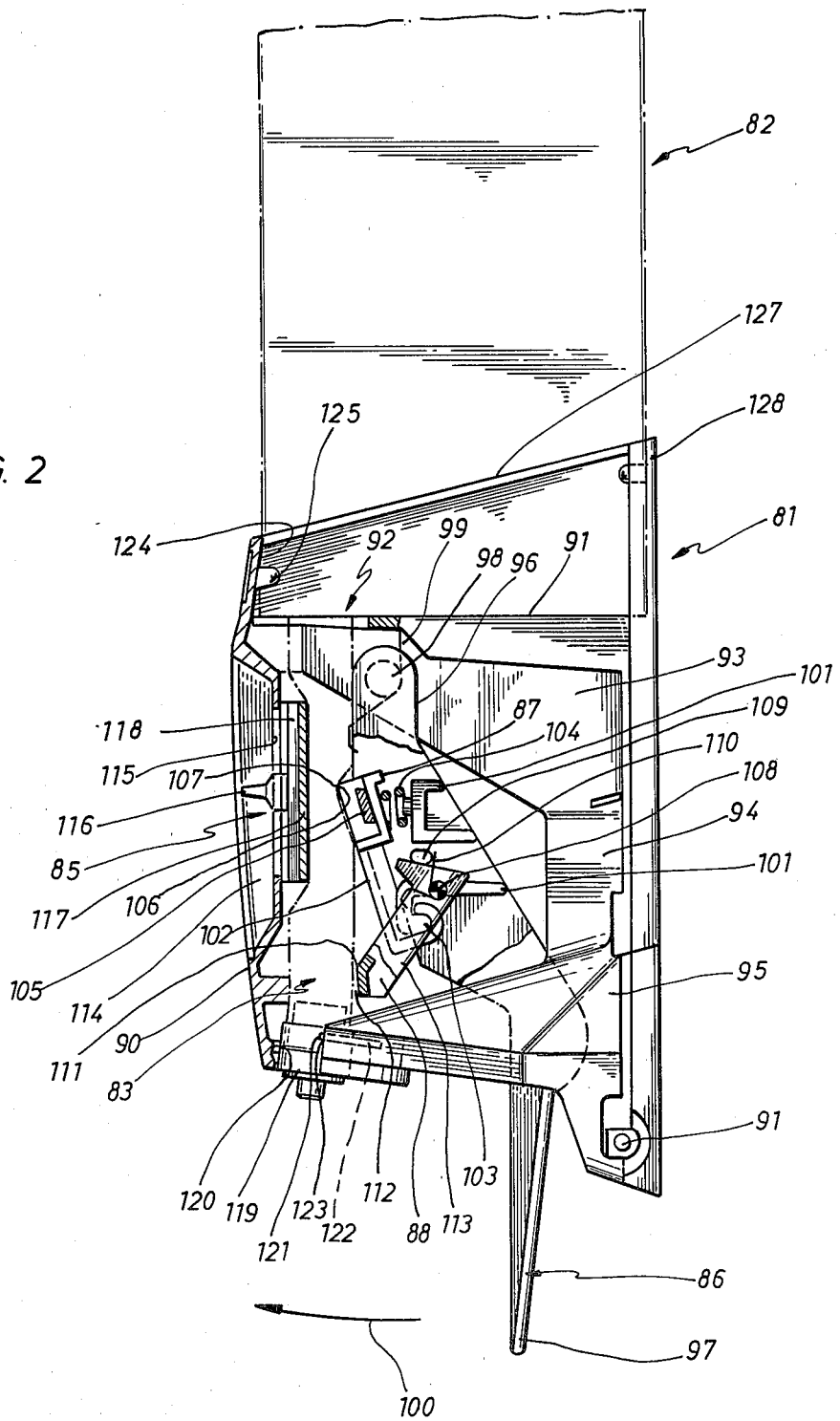
FIG. 2 is a cross-sectional view of the dispenser of the present invention taken along lines 2—2 of FIG. 1.

In FIGS. 1 and 2 the dispenser 81 for liquid or granular materials and the package 82 which contains liquid or granular materials are shown. The package 82 shown in FIG. 2 contains liquid material (not shown) and includes a resilient tube 83 depending downwardly from package 82 and associated therewith. In general, dispenser 81 comprises a housing 84; a backup block 85 associated with housing 84; dispensing arm 86; a first dispensing block 87, or pinch block, associated with dispensing arm 86; and a second dispensing block 88, or pinch block, also associated with dispensing arm 86.

Still with reference to FIGS. 1 and 2 the foregoing components of dispenser 81 will be described in greater detail. Housing 84, which may be manufactured of any suitable material, such as plastic, includes a back member 89 and a cover 90 which is pivotally connected to back member 89 as by pivotal connection 91. Cover member 90 may be pivoted downwardly to open housing 94 to enable access to the interior of housing 84. Back member 89 is adapted to be mounted to any suitable surface such as a wall, mirror, or cabinet, etc., such as by screws or an adhesive tape material. Although housing 84 is preferably made of a suitable plastic material, any other material could be used to manufacture housing 84, provided it has the requisite strength and durability characteristics. Housing 84 includes means for supporting package 82, which support means may support at least a portion of package 82 within housing 84. Thus, a shelf 91 is provided which may be integral with back member 89. Alternatively, housing 84 could be formed so as to allow package 82 to merely be placed upon the top of housing 84. Shelf 91 has a suitable opening 92 formed therein to allow the resilient tube 83 of package 82 to depend downwardly through shelf 91. Housing 84 includes internal rib members 93–95 which may be formed integral with back member 89. Rib members 93–95 serve to support the other components of dispenser 81 within housing 84.

With reference to FIG. 2, it is seen that dispensing arm 86 has a first end portion 96 and a second, free end portion 97 downwardly depending from housing 84. First end portion 96 of dispensing arm 86 is pivotally associated with housing 84 as by the pivotal connection 98 with internal ribs 93. In FIG. 2, dispensing arm 86 is shown in its non-dispensing position wherein dispensing arm 86 is slightly biased into that position by means of spring 99 disposed at pivotal connection 98. Dispensing arm 86 when used to cause liquid or granular material to be dispensed from dispenser 81 will have an actuating force exerted upon it to cause dispensing arm 86 to be pivoted about pivotal connection 98 in the direction shown by arrow 100. The second, free end portion 97 of dispensing arm 86 extends downwardly from housing 84 a sufficient distance to easily enable a user of dispenser 81 to place his or her finger tips behind the free end portion 97 of dispensing arm 86 to pull it outwardly in the direction shown by arrow 100.

Still with reference to FIG. 2, it is seen that dispensing arm 86 has the first dispensing block 87 and the second dispensing block 88 associated therewith. Dispensing arm 86 includes a plurality of ribs, shown generally at 101 which support dispensing blocks 87 and 88, or pinch blocks, as will be hereinafter described. Pinch block 87 has a depending leg member 102 which is pivotally connected to dispensing arm 86 as shown generally at 103. Dispensing arm 86 is yieldable with respect to the first dispensing block 87, which yieldability is caused by a resilient coil spring 104 disposed between dispensing arm 86 and pinch block 87. Spring 104 is disposed between rib 101 and dispensing block 87 in a recess 105 formed in pinch block 87. It is thus seen that spring 104 is disposed in a spaced relationship from the pivotal connection 103 between dispensing arm 86 and the first dispensing block 87. First dispensing block 87 has a tip portion 106 which, in the non-dispensing location of dispensing arm 86 shown in FIG. 2, slightly abuts against resilient tube 83 at a first predetermined impact point 107 which is adjacent backup block 85.

Second dispensing block 88 is associated with dispenser arm 86, as by the pivotal connection 108 between second dispensing block 88 and dispensing arm 86. Dispensing arm 86 has a small projection 109 formed above pivot point 108, whereby a spring 110 is disposed at pivotal connection 108 between second pinch block 88 and dispensing arm 86; the end of spring 110 being held in place by projection 109. Thus, dispensing arm 86 is yieldable with respect to the second dispensing block 88 via the spring biased pivotal connection 108. Pinch block 88 also has a tip portion 111; however, the tip portion 111 of the second dispensing block 88 is in a spaced relationship from resilient tube 83, as shown at 112, until an actuating force is imposed upon dispensing arm 86. Thus, dispensing block 88 does not apply any force to tube 83 until the actuating force is applied to arm 86. Second dispensing block 88 is of generally U-shaped configuration and has two upwardly extending leg members 113, whereby there are two pivotal connection points 108 for second dispensing block 88.

With reference to FIGS. 1 and 2, it is seen that cover 90 has an indented portion 114 formed therein. Within indented portion 114, a slot 115 is formed through which passes an adjusting knob 116 for moving backup block 85. Backup block 85 has a compression surface 117 thereon which is adjacent first dispensing block 87. By means of any suitable connection, such as by frictional engagement between knob 116 and slot 115 or by frictional engagement between the back portion 118 of backup block 85 and the interior surface of indentation 114 of cover 90, backup block 85 may be moved upwardly or downwardly and can be held in place at any desired location. By movement of knob 116, thus causing the movement of backup block 85, the amount of the compression surface 117 adjacent the first dispensing block 87 is varied. As will be hereinafter discussed with respect to FIGS. 6A–6C and FIG. 7, by moving backup block 85 to vary the amount of compression surface 117 disposed adjacent first dispensing block 87, the amount of material to be dispensed is varied.

Still referring to FIGS. 1 and 2, it is seen that resilient tube 83 has a fitting 119 disposed at the lower end of resilient tube 83 which engages with the cover 90 as shown at 120 and with rib 95 of back member 89 of housing 84 as shown at 121. Preferably, rib 95 is formed with a groove 122 whrich receives a raised projection 123 formed on fitting 119. With cover 90 being opened by pivoting it downwardly about pivotal connection 91, a package 82 with resilient tube 83 having fitting 119 attached thereto, may be placed within housing 84 by passing resilient tube through opening 82 of shelf 91 and inserting raised portion 123 of fitting 119 into groove 122 of rib 95. Cover 90 may then be upwardly pivoted about pivot point 91 to close dispenser 81, whereby dispenser 81 is ready to be used. It should be noted that the interior, upper surface 124 of cover 90 may be provided with a plurality of projections 125 which cooperate with suitable openings in package 82. Upon closing cover 90, projections 125 engage with the openings 126 of package 82 to position and secure package 82 upon shelf 91 of housing 94 in cooperation with the raised side walls 127 of cover 90 and the upper end portion 128 of back member 89 of housing 84. Housing 84 may be provided with any suitable latching device (not shown) to secure cover 90 in the closed position shown in FIG. 2 or to allow cover 90 to be opened and pivoted about pivot point 91 to its open position.

Figure 3:
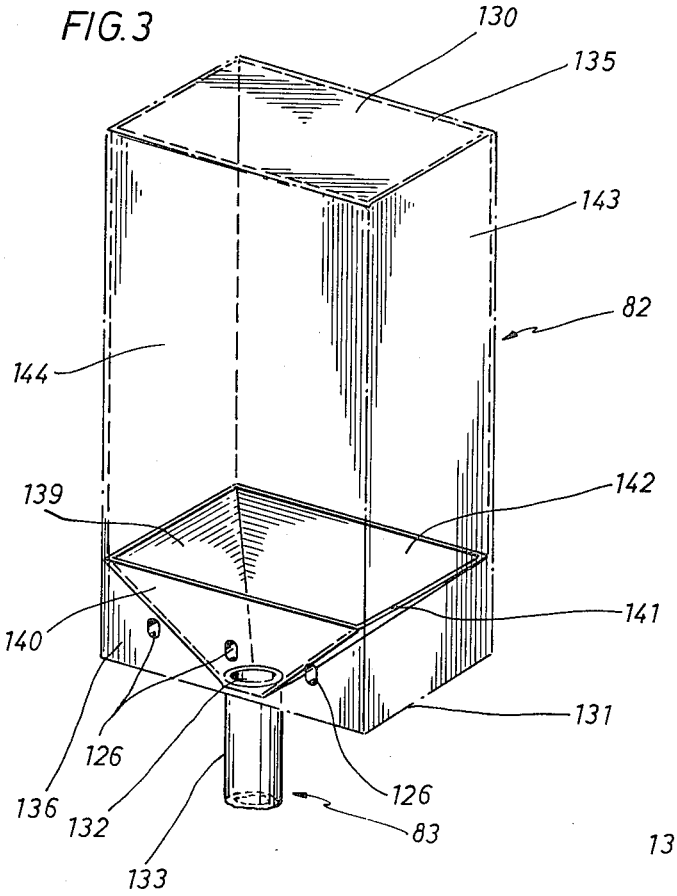
FIG. 3 is an isometric of the package of the present invention.

Turning now to FIG. 3, the package 82 of the present invention will be described in greater detail. Package 82 is seen to comprise a housing 129 having upper and lower ends 130 and 131 with an opening 132 formed in the lower end 131 of housing 129. Resilient tube 83, having an upper end 133 and a lower end 134 (FIGS. 4 and 5), extends downwardly from the lower end 131 of housing 129. The upper end 133 of resilient tube 83 is in communication with opening 132. In the preferred embodiment, housing 129 is shown to have a generally rectangular cross-sectional configuration, but of course it could be of any cross-sectional configuration, provided the mating recess for package 82. In housing 84 formed by cover 90, cover sidewalls 127 and back wall 128 of back member 89 (FIGS. 1 and 2) conforms to the cross-sectional configuration of housing 129. Housing 129 may include a flexible plastic liner 135 for holding either the granular material or liquid material to be dipensed by dispenser 81. The front, lower wall 136 of housing 129 has a plurality of openings 126 formed therein which cooperate with projections 125 to provide a means for positioning the lower end 131 of housing 129 within dispenser 81. Of course, it should be realized that other suitable positioning means could be utilized. For example, the location of openings 126 and projections 125 could be reversed, as by providing suitable openings (not shown) in cover 90 for engagement with suitable projections (not shown) formed on the front, lower wall of housing 129 to thereby position package 82 within housing 84 of dispenser 81.

Figure 4:
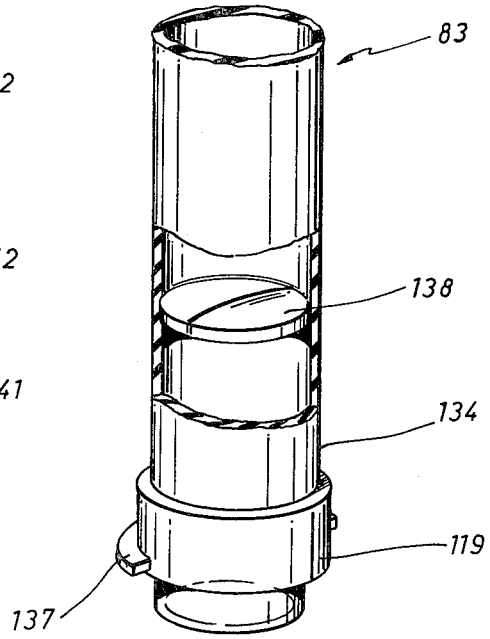
FIG. 4 is a partial cross-sectional view of a portion of the package of the present invention.

Still referring to FIGS. 3 and 4, the package for granular material 82 of the present invention will be described in greater detail. The lower end 134 of resilient tube 83 has a fitting 119 attached to resilient tube 83. Fitting 119 has a means for positioning the lower end 134 of resilient tube 83 within dispenser 81, as by the raised rib member 137, previously described in connection with slot 22 of housing 84. Intermediate the upper end 133 and lower end 134 of resilient tube 83 is disposed a slit diaphragm valve 138 which is adapted to be opened and closed by dispenser 81 to allow egress of the granular material from resilient tube 83, as will be hereinafter described in greater detail in connection with FIG. 7. Slit diaphragm valve 138 as shown in FIG. 4, is in the closed position whereby any granular material disposed above slit diaphragm valve will be precluded from passing beyond valve 138 and is retained above the valve 138 within tube 83. Preferably, resilient tube 83 and valve 138 are formed of latex rubber, as by injection molding. Of course any other material could be used if it has the requisite flexibility characteristics and compatibility for use with the materials being dispensed, as well as provides a positive seal for valve 138.

Referring back to FIG. 3, it is seen that the package 82 for granular material includes means for directing the granular material toward opening 132. The means for directing the granular material preferably includes at least one surface which is slanted with respect to the longitudinal axis of housing 129. Preferably the means for directing the granular material comprises four surfaces 139–142 disposed within the lower end 131 of housing 129, surfaces 139–142 being slanted with respect to the longitudinal axis of housing 129. As seen in FIG. 3, surfaces 139–142 are slanted downwardly toward opening 132, whereby a chute is formed to direct the material toward opening 132. Opening 132 is disposed substantially in the center of the lower end 131 of housing 129, but it does not necessarily have to be disposed equidistant from each of the four walls of housing 129. Thus, opening 132 can be equidistant between the two side walls 143 and 144 of housing 129, but disposed closer to the front wall 136 of housing 129 as is also depicted in FIG. 2.

Figure 5:
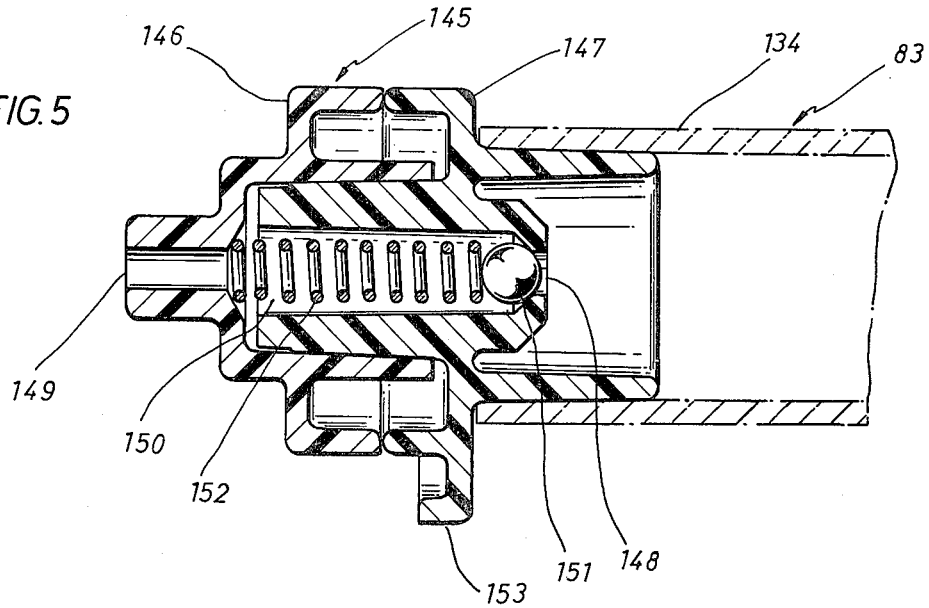
FIG. 5 is a cross-sectional view of a long-throw ball check valve for use in the dispenser of the present invention.

With respect to the package for dispensing liquid material, reference will now be made to FIGS. 3 and 5. When liquid material is being contained within package 82, the lower end 134 of resilient tube 183 has a spring-biased, long throw, check valve 145 disposed within the lower end 134 of resilient tube 183.

Check valve 145 includes an elongated valve housing, formed in two parts 146 and 147, having a first inlet orifice 148, and a second downstream or outlet orifice 149. An elongated valve chamber 150 contains a ball element 151 biased toward the closed, or seated position, by a biasing element, such as a coil spring 152. When package 82 is used to contain a liquid material to be dispensed by dispenser 81, slanted surfaces 139–142 are not necessary to direct the liquid material toward opening 132, whereby if desired, slanted surfaces 139–142 may be deleted from package 82. As with granular material, package 82 may include a flexible plastic liner 135.

Valve housing member 147 may include a means for positioning the resilient tube 83 within dispenser 81 as by the raised rib portion 153 which cooperates with slot 122 of dispenser 81 as previously described in connection with FIG. 2.

Figure 6A:
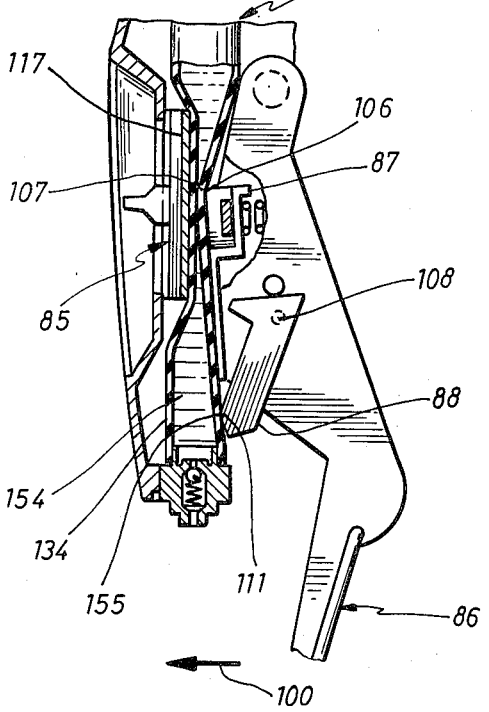
FIGS. 6A–6C are partial cross-sectional views of the dispenser of the present invention illustrating the dispensing of a liquid material.
Figure 6B:
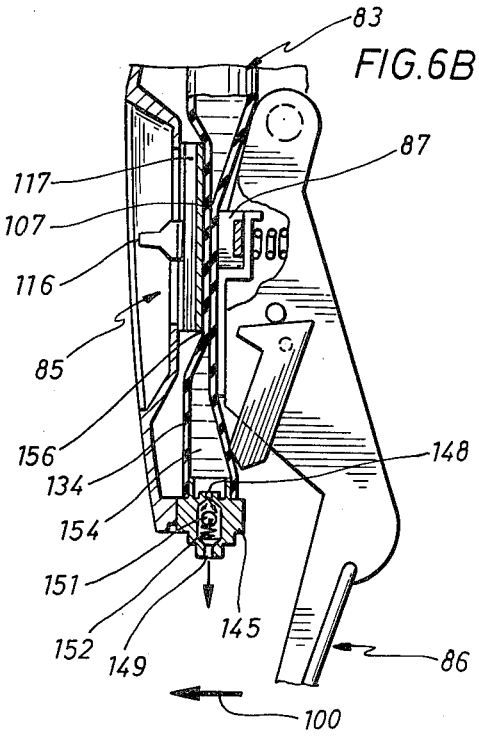
Figure 6C:
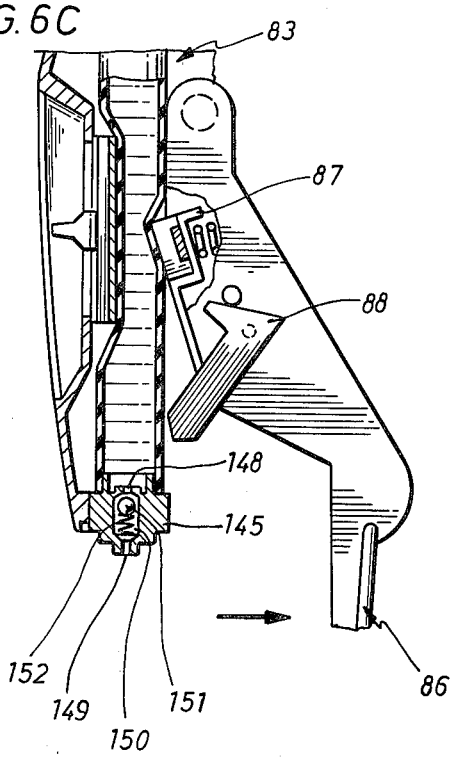

Turning now to FIGS. 6A–6C, the operation of the dispenser of the present invention when used to dispense a liquid material will be described. FIG. 6A illustrates the position of the components of the dispenser after an initial actuating force has been applied to dispensing arm 86 in the direction indicated by arrow 100. Upon movement of the dispensing arm 86 in the direction shown by arrow 100 first dispensing block 87 contacts resilient tube 83 at a first predetermined impact point 107 to compress the resilient tube 83 against the compression surface 117 of backup block 85. Resilient tube 83 is thus pinched off and closed at impact point 107, leaving liquid material 154 entrapped within the lower end 134 of resilient tube 83. The tip portion 106 of first dispensing block 87 is the part of first dispensing block 87 which first makes contact with resilient tube 83 at impact point 107. With dispensing arm 86 in the position shown in FIG. 6A, second dispensing block 88 has been moved toward the lower end 134 of resilient tube 83, whereby its tip portion 111 has pivoted about pivot point 108 into contact with resilient tube 83 at a second predetermined impact pointer 155. Second impact point 155 is spaced from, and below, the first impact point 107, whereby second dispensing block 88 begins to apply a force to resilient tube 83.

Turning now to FIG. 6B, the actuating force applied to dispensing arm 86 in the direction shown by arrow 100 has been continued whereby resilient tube 83 has been fully compressed between first dispensing block 87 and compression surface 117 of backup block 85. The amount of the compression surface 117 of backup block 85 which is utilized in FIG. 6B extends between first impact point 107 and the lower corner 156 of compression surface 117 of backup block 85. The compression of the resilient tube 83 by first dispensing block 87 against the portion of compression surface 117 disposed between impact point 107 and the lower corner 156 of backup block 85 causes the liquid material 154 to be moved downwardly through resilient tube 83 and into the inlet orifice 148 of the check valve 145. The pressure of the liquid material 154 disposed within the lower end 134 of resilient tube 83 overcomes the biasing force of spring 152 and check valve 145, whereby ball element 151 moves downwardly allowing liquid material 154 to pass through the check valve 145 and through outlet orifice 149.

It should be noted that by moving adjustment knob 116 of backup block 185 downwardly, first dispensing block 87 would be compressing resilient tube 83 against a greater amount of compression surface 117 disposed between first impact point 107 and the lower edge 156 of compression surface 117 of backup block 85. Thus, more compressive force would be imposed upon the liquid material 154 disposed in the lower end 134 of resilient tube 183, and accordingly a greater volume of viscous liquid would be forced out of check valve 145. Likewise, by moving adjustment knob 116 upwardly, a lesser amount of compression surface 117 of backup block 85 would be cooperating with first dispensing block 87, whereby less compressive force would be generated which would result in less viscous material being forced out of check valve 145.

Turning now to FIG. 6C, the actuating force upon dispensing arm 86 has ceased and dispensing arm 86 is returning to its normal position as has been described in connection with FIG. 2. Cessation of the actuating force on dispensing arm 86 stops the generation of the compressive force on the viscous liquid within the resilient tube 83, whereby the biasing force of spring 152 and check valve 145 becomes dominant and forcefully throws the ball element 151 upwardly toward and against its seat adjacent inlet orifice 148. The rapid return of the ball element 151 to its seat adjacent the inlet orifice 148 within the valve chamber 150 generates a suction force which draws any viscous liquid that remains adjacent the exterior of outlet orifice 149 back into valve chamber 150 or into tube 83. Therefore, unsightly and unsanitary coagulation and accumulation of viscous liquid about the exterior of the check valve 145 is effectively prohibited.

Figure 7:
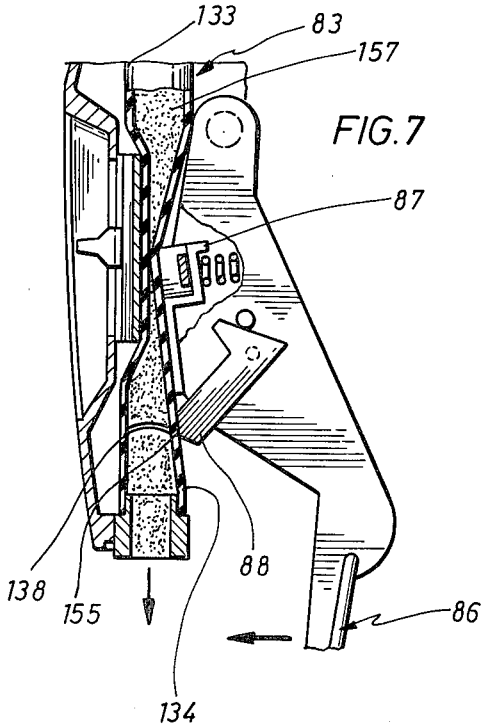
FIG. 7 is a cross-sectional view of the dispenser of the present invention when dispensing granular material.

Turning now to FIG. 7, the dispenser of the present invention is shown dispensing a granular material 157. The dispensing arm 86 is in the same position as that shown and described in FIG. 6A. When the dispenser of the present invention is utilized to dispense granular material, it is seen that the force imposed by second dispensing block 88 at the second predetermined impact point 155 is applied to the slit diaphragm valve 138 which is disposed intermediate the ends 133 and 134 of resilient tube 83. Thus, second dispensing block 88 causes slit diaphragm valve 138 to open which allows egress of granular material 157 from tube 83. Upon cessation of the actuating force being applied to dispensing arm 86, the cessation of the force exerted upon slit diaphragm valve 138 by second dispensing block 88 allows slit diaphragm valve 138 to assume its normal closed position and prevent further egress of granular material from resilient tube 83.

It is to be understood that the invention is not limited to the exact details of construction, operation, exact materials, or embodiments shown and described, as obvious modifications and equivalents will be apparent to one skilled in the art; for example, the location of the components within the housing could be reversed whereby the dispenser is actuated by a pushing movement, rather than a pulling movement of the dispenser arm. Accordingly, the invention is therefore to be limited only by the scope of the appended claims.

What is claimed is:

1. Apparatus for dispensing liquid or granular materials, for use with a package which contains liquid or granular material and has a resilient tube associated with said package, comprising:

a housing, said housing including means for supporting said package;

a backup block, having a compression surface thereon, associated with said housing;

a dispensing arm having a first end portion pivotally associated with said housing and having a second, free end portion;

a first dispensing block associated with said dispensing arm, said first dispensing block being disposed adjacent the compression surface of said backup block; and a second dispensing block pivotally and yieldably mounted (associated) with respect to said dispensing arm, said second dispensing block disposed beneath, and spaced from, the first dispensing block whereby, upon an actuating force being imposed upon the free end portion of said dispensing arm, the first dispensing block contacts the resilient tube at a first predetermined impact point to compress the resilient tube against the compression surface of the backup block, and the second dispensing block contacts the resilient tube at a second predetermined impact point spaced from, and below, said first impact point, to apply a force to the resilient tube.

2. The apparatus of claim 1, wherein the backup block is adjustably associated with said housing whereby, upon movement of said backup block, the amount of said compression surface adjacent the first dispensing block is varied.

3. The apparatus of claim 1, wherein each dispensing block has a tip portion and the tip portion of said second dispensing block is disposed beneath, and spaced from, the backup block.

4. The apparatus of claim 1, wherein the first dispensing block is pivotally connected to said dispensing arm.

5. The apparatus of claim 4, wherein the dispensing arm is yieldable with respect to the first dispensing block, and the dispensing arm includes a resilient spring disposed between said dispensing arm and the first dispensing block.

6. The apparatus of claim 5, wherein the spring is disposed in a spaced relationship from the pivotal connection between the dispensing arm and the first dispensing block.

7. The apparatus of claim 1, wherein a resilient spring is disposed between the dispensing arm and the second dispensing block.

8. The apparatus of claim 7, wherein the spring is disposed at the pivotal connection between the dispensing arm and the second dispensing block.

9. The apparatus of claim 1, wherein the second dispensing block does not apply any force upon said resilient tube until the actuating force is imposed upon the dispensing arm.

10. The apparatus of claim 1, wherein the first dispensing block has a tip portion which first engages the resilient tube at the first predetermined impact point to compress the resilient tube against the backup block.

11. The apparatus of claim 1 wherein said means for supporting is disposed within the housing and supports at least a portion of said package within the housing.

12. The apparatus of claim 11 wherein said housing includes means for positioning and securing at least a portion of said package within the housing.

* * * * *

UNITED STATES PATENT AND TRADEMARK OFFICE

CERTIFICATE OF CORRECTION

PATENT NO. : 4,394,938

DATED : July 26, 1983

INVENTOR(S) : John R. Frassanito

It is certified that error appears in the above-identified patent and that said Letters Patent are hereby corrected as shown below:

In Claim 1, line 17, delete "(associated)".

Signed and Sealed this

*Eleventh* Day of *June 1985*

[SEAL]

*Attest:*

DONALD J. QUIGG

*Attesting Officer* *Acting Commissioner of Patents and Trademarks*